US005174789A

United States Patent [19]

Yu et al.

[11] Patent Number: 5,174,789

[45] Date of Patent: Dec. 29, 1992

[54] ELECTRICAL CONNECTOR WITH ENHANCED COUPLING

[75] Inventors: Nobbert Yu, Culver; Tim Chang, Chino Hills; Jason Jan, Rowland Heights, all of Calif.

[73] Assignee: Foxconn International, Inc., Sunnydale, Calif.

[21] Appl. No.: 823,336

[22] Filed: Jan. 21, 1992

[51] Int. Cl.[5] ..... H01R 13/648

[52] U.S. Cl. ..... 439/607; 439/904

[58] Field of Search ..... 439/607, 609, 610, 92, 439/95, 108, 345, 357, 901, 904, 905

[56] References Cited

U.S. PATENT DOCUMENTS

| | | | |
|---|---|---|---|
| 4,708,412 | 11/1987 | Himes, Jr. et al. | 439/607 X |
| 4,808,125 | 2/1989 | Waters et al. | 439/607 |
| 4,822,303 | 4/1989 | Nakamura et al. | 439/607 |
| 4,854,890 | 8/1989 | Nishimura | 439/607 |
| 4,902,242 | 2/1990 | Davis et al. | 439/404 |
| 4,906,208 | 3/1990 | Nakamura et al. | 439/607 |
| 5,037,331 | 8/1991 | Goodmann et al. | 439/607 |

*Primary Examiner*—Neil Abrams
*Assistant Examiner*—Khiem Nguyen
*Attorney, Agent, or Firm*—Flehr, Hohbach, Test, Albritton & Herbert

[57] ABSTRACT

An electrical connector with enhanced coupling is provided which comprises: an insulative housing (10) including a base portion (11), and an upstanding portion (12) defining a plurality of conduits for housing individual electrical contacts; a metal housing (20) including a flange (21), a shell (22) upstanding from the flange and defining a first opening (24) sized to receive and encompass the upstanding portion of the insulative housing, and first and second tabs (23) depending downward from the flange; a bracket (30) including a mounting surface (31) that defines a second opening (32) sized to permit passage therethrough of the upstanding portion of the insulative housing, the mounting surface also defining first and second cavities (34) on opposite sides of the second opening sized to receive the first and second tabs when the first and second openings are aligned; first latch mechanism (33) for securing the first tab to the bracket when the first tab is received within the first cavity; and second latch mechanism (33) for securing the second tab to the bracket when the second tab is received within the second cavity.

20 Claims, 4 Drawing Sheets

ELECTRICAL CONNECTOR WITH ENHANCED COUPLING

BACKGROUND OF THE INVENTION

1. Field of the Invention

This invention relates to electrical connector assemblies and, more particularly, to electrical connector assemblies including an insulative housing member disposed within a conductive shell.

2. Description of the Related Art

Electrical connectors typically comprise multiple components such as a metal shell, a metal bracket, and an insulator that houses a plurality of contacts. The metal shell partially encloses the insulative housing, and the metal shell and the insulative housing are both secured to the bracket with the shell in physical and, therefore, electrical contact with the bracket. This electrical contact provides electrical shielding for the connector. The insulative housing itself can house multitudinous individual electrical contacts which are electrically isolated from each other within the housing.

Typically, electrical connectors are employed within hardware systems such as personal computers. With the insulative housing exposed, external contacts can plug into the electrical contacts to electrically connect individual contacts.

The connectors, when mated together, provide electrical connection between separate pieces of hardware. The use of such connectors allows hardware to be reconfigured because a connector may be mated and unmated to several different connectors over time. This continual process of mating and unmating, however, can create stress on the connector itself.

Over time, repeated matings and unmatings can loosen the electrical and physical connections between components. Specifically, pushing down while mating and pulling up while unmating places stress on the electrical coupling between the metal shell and bracket and the physical coupling between all three components. Over the course of a connector's life, these repeated stresses can cause fatigue and ultimately failure of the physical coupling.

Barbs have been used in earlier electrical connectors. However, barbs can be prone to stress fatigue. Barbs tend to be small, tapered protrusions that jut out of the plane of the mounting surface of the bracket. These small, tapered structures can fatigue much faster that larger, less tapered structures.

Thus, there has been a need for an improved mechanism for coupling the separate components of an electrical connector together. Additionally, there has been a need to have a mechanism to reinforce the coupling that does not significantly add to the cost of manufacture.

SUMMARY OF THE INVENTION

The present invention comprises an insulative housing, a metal housing, a bracket, and first and second latching mechanisms for securing the bracket and metal housing together. The bracket includes a mounting surface that defines a first opening, and two cavities on either side of the opening. The metal housing includes a flange, an metal shell upstanding from the flange that defines a second opening, and two tabs sized to fit into the bracket cavities. The first and second latching mechanisms secure the tabs within the cavities.

In a present embodiment, the insulative housing includes a base portion, a contact housing that upstands from the base, and a insulative shoulder that surrounds the contact housing. When the insulative housing is coupled to the metal housing and bracket, the contact housing is pushed through the openings of both the bracket and the metal housing. The insulative shoulder abuts against the first and second latching mechanisms when the insulative housing is properly coupled.

The present invention solves the problem of providing a cost effective mechanism for connecting the components of an electrical connector together, and providing an inexpensive means of reinforcing the connection. The connection is achieved by securing the latching mechanisms on the bracket to the tabs on the metal housing. These latching mechanisms are easily and inexpensively reinforced by use of the shoulders on the insulative housing. Once assembled, the shoulders abut against the tabs to insure that the latching mechanisms securely hold the tabs in place within the cavities.

These and other features and advantages of the present invention will become more apparent from the following description of exemplary embodiments thereof, as illustrated in the accompanying drawings.

The purpose and advantages of the present invention will be apparent to those skilled in the art from the following detailed description in conjunction with the appended drawings.

DETAILED DESCRIPTION OF THE PREFERRED EMBODIMENT

The present invention provides an electrical connector with enhanced coupling. The following description is presented to enable any person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded with the widest scope consistent with the principles and features disclosed herein.

Figure 1:
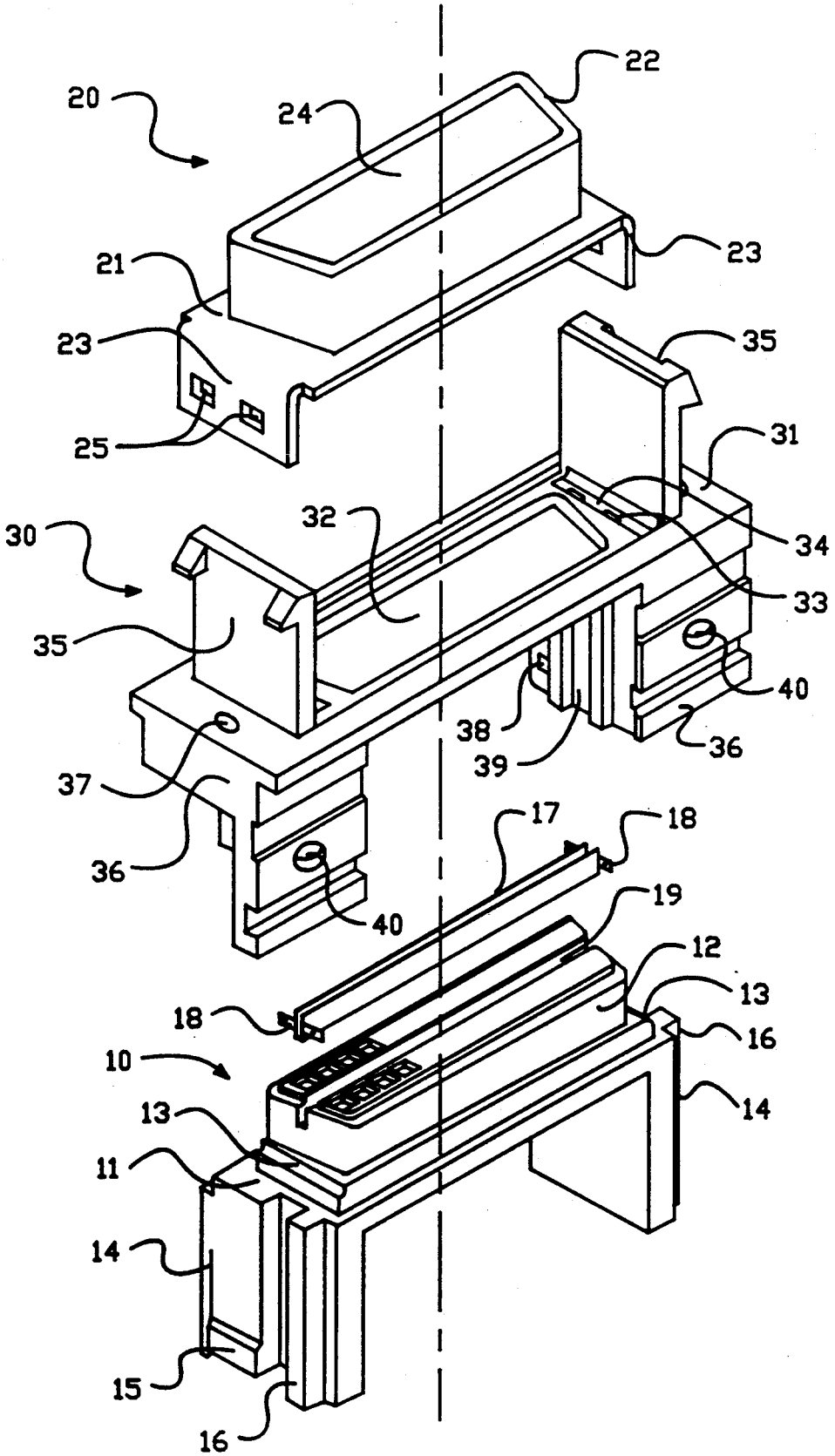
FIG. 1 is an exploded perspective view of the components that comprise the electrical connector in accordance to the present invention.

Referring to FIG. 1, there is shown an exploded perspective view of the components of a presently preferred embodiment of an electrical connector in accordance to the present invention. The connector comprises an insulative housing 10, a metal shell 20, and a bracket 30. FIG. 1 shows these components in their relative alignments prior to assembly.

The insulative housing 10 includes a base portion 11 and an upstanding portion 12. The upstanding portion 12 defines a plurality of conduits that can house a plurality of individual pin contacts (not shown). A slot 19 transverses the length of the upstanding portion 12 and is formed to receive the metal blade 17. Tangs 18, formed on opposite ends of the metal blade 17, secure the metal blade 17 to the upstanding portion 12. The upstanding portion 12 is substantially surrounded by a shoulder 13. Depending downward from opposite ends of the base portion 11, are the supports 14 which include fasteners 15 and guide bars 16.

The metal housing 20 includes a metal shell 22 that upstands from a flange 21 and defines a trapezoidal opening 24. Tabs 23 depend down from the flange 21 and include slots 25 therein.

The bracket 30 includes a mounting surface 31 that defines a trapezoidal opening 32 and two screw holes 37, hooks 35 formed on either side of the mounting surface 31, cavities 34 sized to receive the tabs 23, and protrusions 33 formed inside the cavities 33 and sized to fit snugly into the tab slots 25. Depending down from opposite sides of the mounting surface 31 are bracket legs 36 which include inwardly facing guide slots 39, notches 38 and screw holes 40.

To assemble the connector, the metal housing 20 is first secured to the bracket 30 by aligning the metal housing opening 24 with bracket opening 32 and aligning the tabs 23 with the corresponding cavities 34. The metal housing 20 is then pushed down onto the bracket 30 until the tabs 23 are extended into the bracket cavities 34 and the bracket protrusions 33 have engaged, or latched into, the tab slots 25. FIG. 6, discussed below, describes more fully the latching action of the tab slots to the bracket protrusions.

In the preferred embodiment, the metal housing flange 21 abuts the bracket mounting surface 31 when these components are connected together. It should be understood that this abutment between the flange and the mounting surface is not required to practice the present invention and is one of many possible arrangements.

Once the metal housing 20 is coupled to the bracket 30, the insulative housing 10 is secured to the bracket 30 by aligning the housing guide bars 16 with the bracket guide slots 39. The insulative housing 10 is then pushed up until the upstanding portion 12 has fully extended through both the bracket opening 32 and the metal housing opening 24 and the insulator fasteners 15 have engaged the bracket notches 38.

Figure 2:
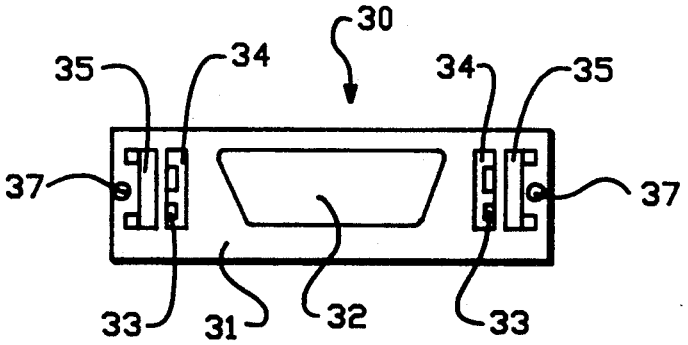
FIG. 2 is a top elevation of the bracket component.

FIG. 2 provides a top perspective view of the bracket component. From this perspective, a better view is provided of both the cavities 34 and the protrusions 33. Although the preferred embodiment uses two cavities, each with two protrusions, it should be understood that those numbers should not be construed as a limitation of the present invention.

Figure 3:
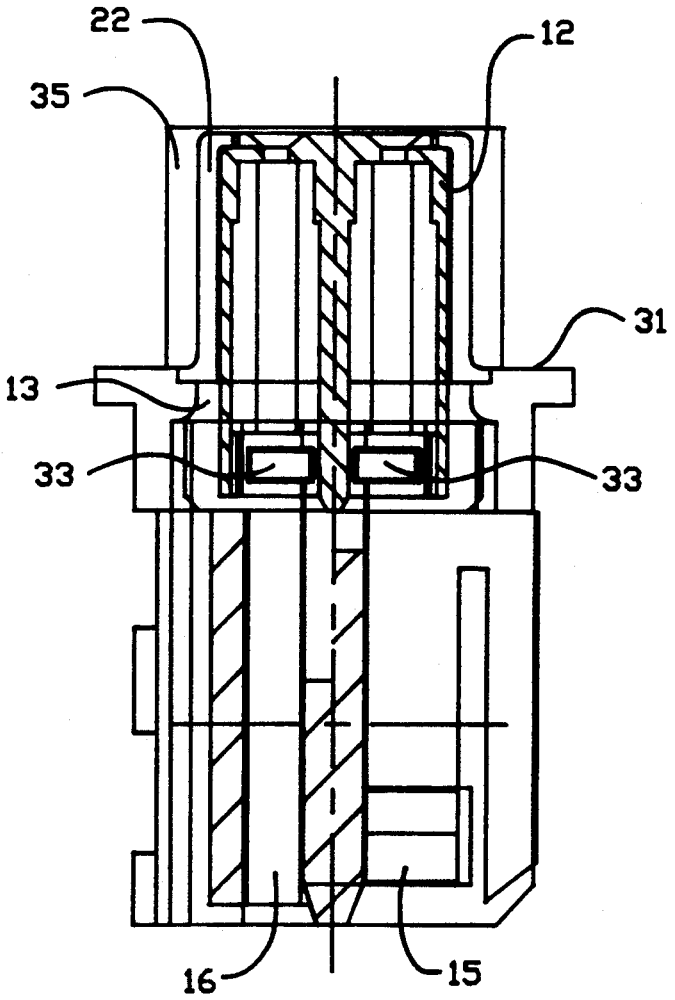
FIG. 3 is a side, sectional view of the electrical assembly as assembled in the presently preferred embodiment of the present invention.
Figure 4:
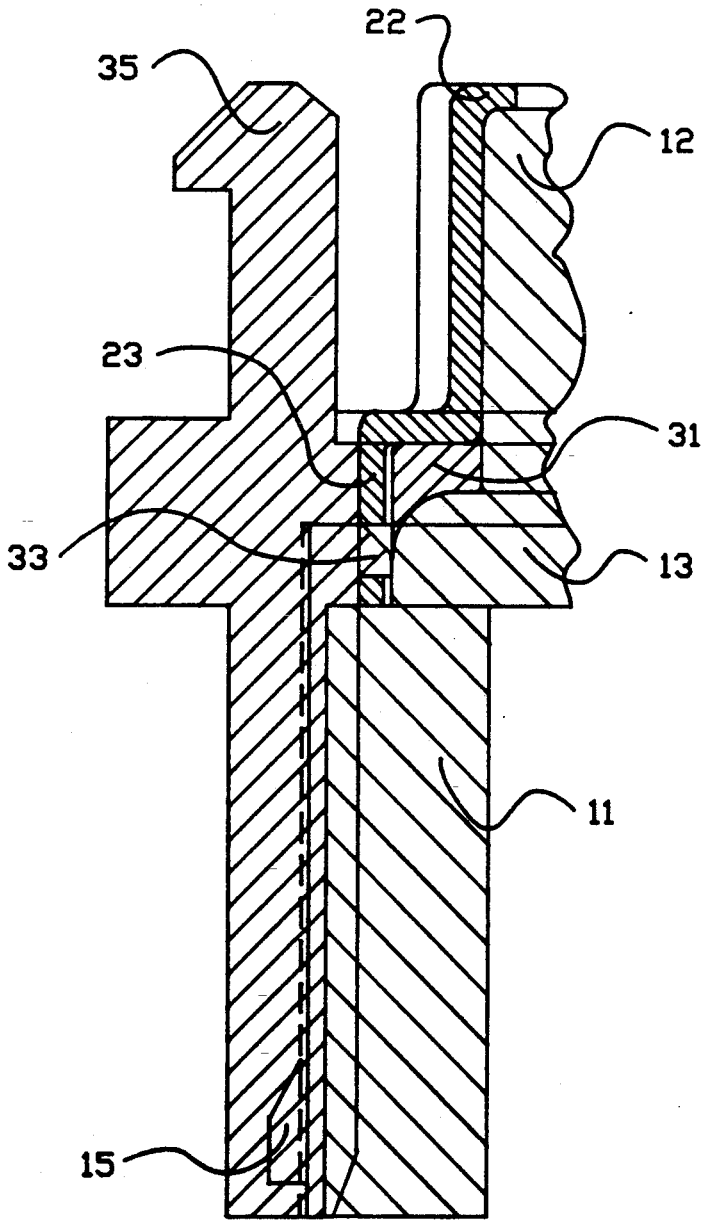
FIG. 4 is a front, sectional view of the bracket, the metal housing and the insulative housing as assembled in the presently preferred embodiment of the present invention.

Once assembled, the electrical connector of the presently preferred embodiment resembles the configurations shown in FIGS. 3 and 4. FIG. 3 is a side, sectional view of the assembled connector, whereas FIG. 4 is a front, sectional view. FIG. 3 demonstrates how the metal housing 20 and the insulative housing 10 are latched to the bracket 30. FIG. 4 also demonstrates the latching of the metal housing 20 and the insulative housing 10 to the bracket 30. Additionally, FIG. 4 demonstrates how the insulator shoulder 13 abuts against the metal tab 22 and the bracket protrusion 33.

A further advantage of the present invention is provided by use of the shoulders 13. FIG. 4 shows how the shoulders 13 reinforce the physical coupling of the bracket protrusions 33 to the metal tabs 23. The shoulder 13 provides this reinforcement by preventing the metal tabs 23 from bending inwardly so as to uncouple from the protrusions 33.

Figure 5:
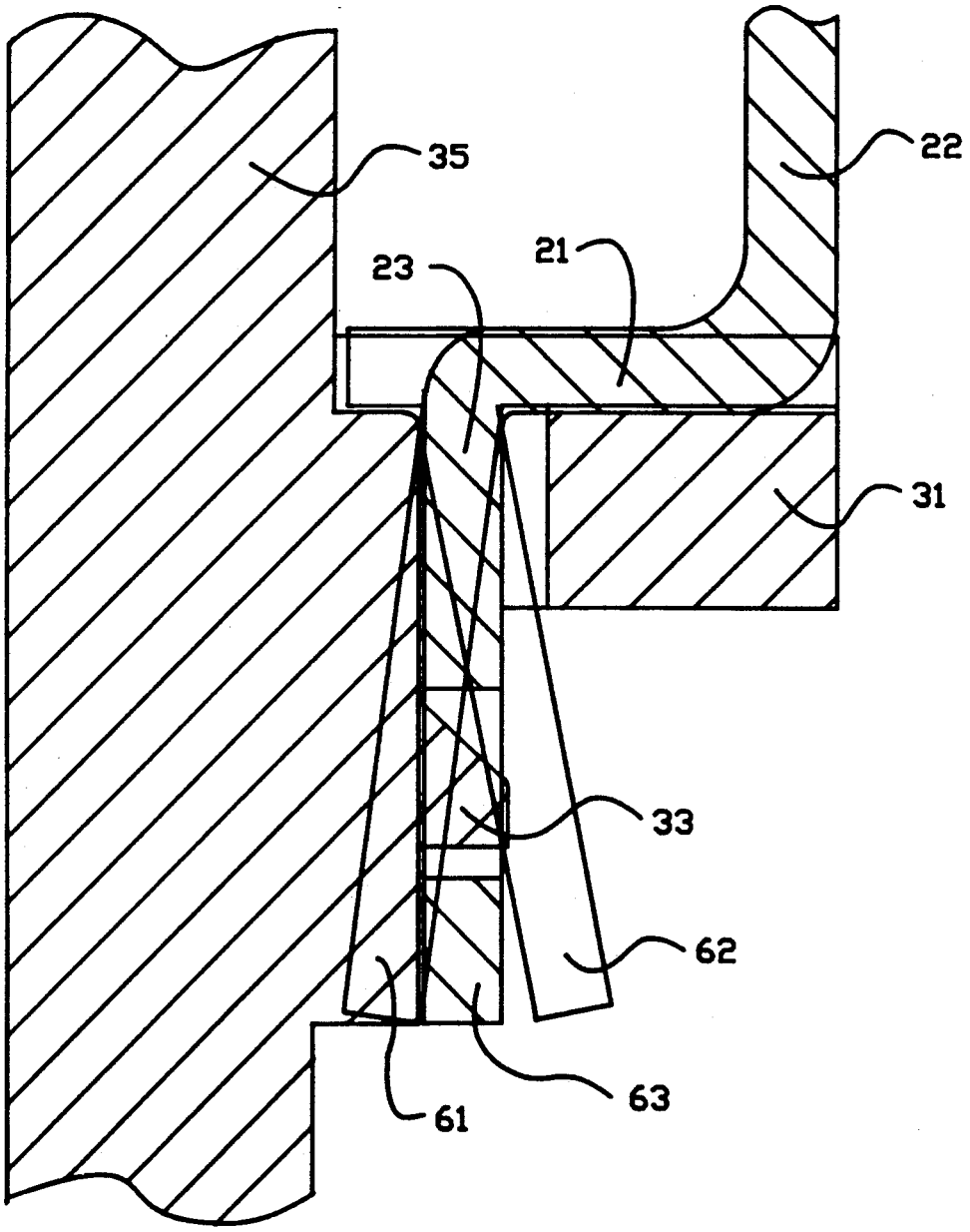
FIG. 5 is a sectional view of the action made by the bracket latching mechanism and the metal tabs during the process of assembly.

FIG. 5 shows the various alignments of the metal tab 23 before, during and after coupling the metal tab 23 to the bracket protrusion 33. In the preferred embodiment, the metal tabs 23 are pre-loaded to provide greater coupling with the bracket. Pre-loading of the tabs 23 is accomplished by forming the tabs 23 in such a fashion that the tabs 23 project downward and slightly away from the center of the metal housing 20. Thus, the tab position labelled 61 shows the natural alignment of the pre-loaded tabs 23 before coupling.

During coupling, the metal housing 20 is top-loaded onto the bracket 30 by pushing the tabs 23 down into bracket cavity 34. The tabs 23 eventually meet with bracket protrusions 33. This meeting forces the pre-loaded tabs 23 to stress back towards the center of the metal housing 20. This intermediate alignment during assembly is shown in tab position labelled 62.

This stressing continues until the protrusions 33 align with the tab slots 25. When this occurs, coupling is complete. The tabs 23 snap to tab position labelled 63 where the tabs 23 abut the side of the bracket 30. The tabs 23 snap outwardly to tab position labelled 63 because of the pre-loading of the tabs 23. It will be appreciated that the pre-loaded tabs naturally press outwardly against the walls of the cavities which tends to keep the protrusions securely fixed within the tab slots. Once the metal housing 20 and the bracket 30 are coupled, the insulator shoulder 13 reinforces this coupling as described in FIG. 4.

One advantage of top-loading the metal housing 20 onto the bracket 30 is the ease of loading the insulative housing 10 onto the bracket 30 from the bottom. Additionally, top-loading allows the metal housing 20 and the insulative housing 10 to be secured directly to the bracket 30. Thus, the assembled connector has a more durable physical coupling.

While a particular embodiment of the invention has been described in detail, it will be understood that the invention may be implemented through alternative embodiments. For example, a latching mechanism could be implemented in which protrusions were formed in the tabs and protrusion-receiving slots were formed in the cavities. Thus, the scope of the invention is not intended to be limited to the embodiment described above, but is to be defined by the appended claims.

What is claimed is:

1. An electrical connector assembly comprising:

an insulative housing including a base portion, and an upstanding portion defining a plurality of conduits for housing individual electrical contacts;

a metal housing including a flange, a shell upstanding from said flange and defining a first opening sized to receive and encompass said upstanding portion of the insulative housing, and first and second tabs depending downward from said flange;

a bracket including a mounting surface that defines a second opening sized to permit passage therethrough of said upstanding portion of said insulative housing, said mounting surface also defining first and second cavities on opposite sides of said second opening sized to receive said first and second tabs when said first and second openings are aligned;

first latch means for securing said first tab to said bracket when said first tab is received within said first cavity; and second latch means for securing said second tab to said bracket when said second tab is received within said second cavity.

2. The electrical connector assembly as defined in claim 1 wherein, said first latch means includes a first protrusion formed in said first cavity and a first slot formed in said first tab and sized to receive the first protrusion when said first tab is received within said first cavity; and said second latch means includes a second protrusion formed in said second cavity and a second slot formed in said second tab and sized to receive the first protrusion when said second tab is received within said second cavity.

3. The electrical connector assembly as defined in claim 2 wherein, said first latch means includes two first protrusions formed in said first cavity and two first slots formed in said first tab and sized to receive the first protrusions when said first tab is received within said first cavity; and said second latch means includes two second protrusions formed in said second cavity and two second slots formed in said second tab and sized to receive the first protrusions when said second tab is received within said second cavity.

4. The electrical connector assembly as defined in claim 1 wherein, said first and second tabs are pre-loaded such that said first and second tabs press outwardly when inserted within said first and second cavities.

5. The electrical connector assembly as defined in claim 1 wherein, said first latch means includes a first protrusion formed in said first cavity and a first slot formed in said first tab and sized to receive the first protrusion when said first tab is received within said first cavity;

said second latch means includes a second protrusion formed in said second cavity and a second slot formed in said second tab and sized to receive said first protrusion when said second tab is received within said second cavity; and said first and second tabs are pre-loaded such that said first and second tabs press outwardly when inserted within said first and second cavities.

6. The electrical connector assembly as defined in claim 1 wherein, said flange abuts against said mounting surface of said bracket when said first and second tabs are received within said first and second cavities.

7. The electrical connector assembly as defined in claim 1 wherein said insulative housing further includes:

first and second shoulders upstanding from opposite sides of said base portion of said insulative housing adjacent to said upstanding portion.

8. The electrical connector assembly as defined in claim 7 wherein:

said first shoulder abuts against said first tab received within said first cavity and said second shoulder abuts against said second tab received within said second cavity.

9. The electrical connector assembly as defined in claim 7 wherein, said first and second shoulders substantially surround said upstanding portion.

10. An electrical connector assembly comprising:

a insulative housing including a base portion, and an upstanding portion defining a plurality of conduits for housing individual electrical contacts;

a metal housing including a flange, a shell upstanding from said flange and defining a first opening sized to receive and encompass said upstanding portion of the insulative housing, and first and second tabs depending downward from said flange, said first tab defining a first slot formed therein and said second tab defining a second tab formed therein;

a bracket including a mounting surface that defines a second opening sized to permit passage therethrough of said upstanding portion of said insulative housing, said mounting surface also defining first and second cavities on opposite sides of said second opening sized to receive said first and second tabs when said first and second openings are aligned;

first latch means for securing said first tab to said bracket when said first tab is received within said first cavity said latch means including a first protrusion formed in said first cavity and sized to snugly fit within the first slot defined by said first tab when said first tab is inserted within said first cavity;

second latch means for securing said second tab to said bracket when said second tab is received within said second cavity said latch means including a second protrusion formed in said second cavity and sized to snugly fit within the second slot defined by said second tab when second tab is inserted within said second cavity; and first and second shoulders upstanding from opposite sides of said base portion of said insulative housing adjacent to said upstanding portion such that said first shoulder abuts against said first tab received within said first cavity and said second shoulder abuts against said second tab received within said second cavity.

11. The electrical connector assembly as defined in claim 10 wherein, said flange abuts against the mounting surface of the bracket when the tabs are latched within the cavities.

12. The electrical connector assembly as defined in claim 10 wherein, said insulative housing includes first and second supports that downwardly depend from said base portion such that said first support includes a first fastener which depends outwardly from said first support and such that said second support includes a second fastener which depends outwardly from said second support; and said bracket includes first and second legs that downwardly depend from said mounting surface such that said first leg includes a first notch sized to receive said first fastener and second leg includes a second notch sized to receive said second fastener.

13. An electrical connector assembly comprising:

an insulative housing including a base portion, and an upstanding portion defining a plurality of conduits for housing individual electrical contacts;

a metal housing including a circumferential shell defining a first opening sized to receive and encompass said upstanding portion of the insulative housing, and at least a tab depending downward from the metal housing;

a bracket including a mounting surface that defines a second opening sized to permit passage therethrough of said insulative housing, said mounting surface also defining at least an upward facing cavity sized to receive said tab of the metal housing when said first and second openings are aligned;

latch means for securing said tab to said bracket when said tab is received within said cavity; and securing means for fastening said insulative housing to said bracket.

14. The electrical connector assembly as defined in claim 13 wherein, said latch includes at least a protrusion in said cavity and at least a slot formed in said tab sized to receive the protrusion when said first tab is received within said cavity.

15. The electrical connector assembly as defined in claim 13 wherein, said assembly further includes:

a securing means for fastening said insulative housing to said bracket.

16. The electrical connector assembly as defined in claim 15 wherein, said securing means includes at least a fastener positioned on said insulative housing, and at least a notch positioned on the bracket sized to receive the fastener when said upstanding portion of the insulative housing is received within the second opening of the bracket.

17. The electrical connector assembly as defined in claim 16 wherein, said insulative housing includes a pair of supports that depend form said base portion oppositely, and at least a guide bar formed on said supports; and said bracket includes a pair of legs that downwardly depend from said mounting surface, and at least a guide slot formed on said legs, such that said guide bar moves along said guide slot when said insulative housing is assembled to the bracket.

18. The electrical connector assembly as defined in claim 13 wherein, said tab is pre-loaded such that said tab presses outwardly when inserted within said cavity.

19. The electrical connector assembly as defined in claim 13 wherein, said assembly further includes:

at least a shoulder positioned on the insulative housing adjacent to said upstanding portion, and abuts against said tab received within said cavity when assembled.

20. The electrical connector assembly as defined in claim 13 wherein, said assembly further includes:

a metal blade positioned within a slot transversely positioned on a mating face of the insulative housing, a pair of tangs extending laterally at each end of said blade to make contact with the shell.

* * * * *